United States Patent [19]

Sorenson et al.

[11] Patent Number: 4,811,860

[45] Date of Patent: Mar. 14, 1989

[54] NESTABLE DISPOSABLE DRINKING RECEPTACLES

[75] Inventors: Carl C. Sorenson; Scott W. Clausen, both of Racine, Wis.

[73] Assignee: SCCS, Incorporated, Racine, Wis.

[21] Appl. No.: 217,937

[22] Filed: Jul. 12, 1988

[51] Int. Cl.[4] ..... B65D 41/26; B65D 43/03; B65D 47/06

[52] U.S. Cl. ..... 220/380; 220/90.2; 220/90.4; 215/1 A; 229/103.1; 206/508; 206/515; 206/519; 206/520

[58] Field of Search ..... 220/90.2, 90.4, 380; 215/119; 229/103.1; 206/508, 515, 519, 520

[56] References Cited

U.S. PATENT DOCUMENTS

| | | | |
|---|---|---|---|
| 2,957,614 | 10/1960 | Krajcovic | 220/90.2 |
| 4,415,097 | 11/1983 | Meins | 220/90.4 |
| 4,428,498 | 1/1984 | Oley | 220/90.4 |
| 4,589,569 | 5/1986 | Clements | 220/380 |
| 4,596,341 | 6/1986 | Bruffey | 220/90.4 |
| 4,607,755 | 8/1986 | Andreozzi | 220/90.2 |
| 4,756,440 | 7/1988 | Gartner | 220/90.4 |

*Primary Examiner*—George T. Hall
*Attorney, Agent, or Firm*—Fitch, Even, Tabin & Flannery

[57] ABSTRACT

A straw is combined with a cup or cup lid to form a nestable and disposable liquid refreshment receptacle or cover therefor. The straw and cup or cup lid are integrally molded to form a one-piece member therefore do not require separate dispensing or subsequent assembly. The straw/lid and straw/cup combinations are made nestable for high density distribution and storage as required for high volume or fast food applications. The straw/lid includes a dual-taper upper drinking extension and a single taper lower liquid engaging member. A recess is formed between cylindrical walls forming the drinking extension into which the drinking extension of an adjacent straw/lid is matingly received or nested during stacking. Further, respective lower liquid engaging members are received with one-another to permit nesting. In similar manner the straw/cups are nestable. Each cup defines a longitudinal recess along its outer side to receive the integrally formed straw of an adjacent cup during stacking.

4 Claims, 3 Drawing Sheets

NESTABLE DISPOSABLE DRINKING RECEPTACLES

The present invention relates to disposable drinking receptacles, in particular, of the type suitable for large volume users such as fast food or refreshment vendors. The present invention also finds application for home, picnic, or party use. More specifically, the present invention pertains to plastic refreshment receptacles, or lids therefor, in which a straw is integrally formed therein. These receptacles and lids are nestable thereby permitting bulk packaging and shipping.

Various combinations of straws and lids/receptacles are known in the prior art. These include include patents to Allen, U.S. Pat. No. 2,432,132; Mainiere, U.S. Pat. No. 2,837,234; Petriccione, U.S. Pat. No. 2,844,267; Drown, U.S. Pat. No. 2,948,453; Griffin, U.S. Pat. No. 3,220,587; Gamblin, U.S. Pat. No. 3,438,527; Chang, U.S. Pat. No. 3,559,868; Lottick, U.S. Pat. No. 4,494,668; and, Park, U.S. Pat. No. 4,582,213. None of these known combinations, however, defines an inexpensive to manufacture, easy to use (i.e. without additional assembly steps), and, importantly, nestable integral straw product.

Drown '453, Lottick '668, and Gamblin '527, for example, are directed to valve structures for use with receptacles having straws and lids thereby preventing spillage in the event of an inadvertent cup upset. These systems employ a separate straw member of conventional cylindrical and uniform cross-section. The lids or caps are not nestable absent removal of the straw therefrom. In any event, the straw must be assembled or inserted into the lid in conventional fashion prior to use.

Allen '132, Petriccione '267, and Park '213 each relate to a straw/cap assembly in which the straw can be released for use by means of a pull-tab arrangement. Again, these beverage receptacles incorporate a separate straw of uniform cylindrical cross-section. There is no pretense of nestability in any of these disclosures.

Mainiere '234 pertains to a multiple-piece bottle cap and straw combination. The straw is of uniform cylindrical cross-section and is positioned within the container during beverage bottling. The straw may be lifted outwardly from the bottle to form an upwardly extending drinking region. Griffin '587 is similar Mainiere in that a uniform cross-section straw is assembled into the bottle during filling. Griffin, however, teaches the use of an outwardly telescoping straw segment to form the required drinking region. Neither arrangement is nestable.

The present invention is directed to straw/receptacle and straw/lid combinations of the type which are generally packaged and shipped to the distributor, vendor, or end-user in bulk quantities. Thus, the present receptacle/lid is typically distributed "dry" with the beverage being added at the time of use.

It is well-known, particularly in the fast food industry, to dispense soft drinks and similar beverages in disposable paper or plastic containers. Lids are generally provided to minimize spillage during beverage transport as well as to protect against insect or other beverage contamination. In this later connection, it being desirable to leave the lid in place during consumption of the beverage, holes are typically provided in the lid through which straws may be inserted. Therefore, in the conventional fast food environment, beverages are dispensed with lid in-place. A straw may be inserted into the container, or it may be separately provided to the customer.

It will be appreciated that the above-described two-piece lid/straw combination requires the vendor to separately order and stock lids and straws; provide separate vending of straws and/or individually insert a straw into each dispensed beverage container. Another problem with the two-piece lid/straw combination is the occasional 'forgetting' of the straw, by vendor or customer alike.

Notwithstanding these limitations, the popularity of separate straw dispensing can be traced to the requirement for high-density bulk packages. It is well-known that conventional cups, lids and straws may be nested or otherwise stacked for high-density packaging and distribution.

The present invention, therefore, relates to integral straw/cup and straw/lid combinations which may be nested for high-density packaging and shipping and which, advantageously, require no secondary assembly operations by the vendor or customer. Nor will vendors be required to separately order, stock, and dispense straws, or inadvertently forget to place straws in customer orders.

To define a useful and marketably acceptable product, however, it is necessary that the straw be positioned in proper relationship to the lid such that it provides both a downwardly extending beverage engaging region as well as an upwardly extending region suitable for user access. In the multiple-piece prior art arrangements, this balance between the beverage engaging and user access regions of the straw is easily accommodated by proper orientation of the straw with respect to the lid during assembly or use.

The integral, unitary construction of the present straw/lid combination, however, precludes or limits the adjustment of the straw with respect to the lid. The straw/lid combination is, in short, fabricated with fixed, predetermined beverage engaging and user access regions. These straw regions extend from the lid in a substantially perpendicular relationship thereto.

It is a feature of the present invention to provide a unitary straw/lid and straw/cup construction while simultaneously maintaining both the above-described spacial relationship between the straw and lid and, importantly, the nestability of the combination product.

It will be seen that a rigid combination of a conventional straw and lid would preclude nesting and high-density packaging by reason that both the upwardly and downwardly extending straw regions would interferingly contact respective adjacent lids in the stack thereby forcing the lids to remain spaced apart a distance equal to the longer of the two straw regions. By contrast, conventional lids nest in tight proximity with the top of one lid typically contacting and resting with the on the bottom of the next adjacent lid.

The present invention, therefore, provides a nesting structure for both the downwardly extending beverage engaging and upwardly extending user access regions of the straw. In this manner, the straw/lid combination of the present invention may be tightly nested in substantially the same high-density relationship found in conventional lid-only packaging.

Specifically, the straw of the present invention defines a 'folded-in' structure wherein the straw, which is intergrally formed with the lid, extends upwardly from the lid a distance sufficient to define the user access region, then, folds back through its own center to form the downwardly extending beverage engaging region. The straw is tapered along its entire length from its point of integral attachment with the lid.

In this manner, the downwardly extending beverage engagement region of each straw may be received within the corresponding region of the next adjacent straw/lid thereby facilitating the nesting therebetween. Importantly, the above-described folded-in geometry results in the user access region of the straw being comprised of dual 'concentric' tapered surfaces which, however, intersect along their respective top edges. This, in turn, defines a recess between the tapered surfaces which recess serves to nestingly receive the corresponding upwardly extending user access region of the next adjacent straw. Thus, the present invention provides a lid/straw geometry in which nesting recesses are provided for both the upwardly and downwarly extending straw regions which, in turn, permits the substantially abutting high-density packaging of the lid portions of the present straw/lid combination.

The above described dual concentric straw arrangement further provides for flexible straw-to-lid mounting in a manner that facilitates the proper and automatic positioning of the straw in the cup. In a conventional beverage container the problem of straw placement does not arise as the user may simply reposition the straw as required.

The preferred arrangement of the present invention is to position the straw away from the center of the lid so that the downwardly extending region of the straw will contact the tapered side of the cup upon placement of the straw/lid combination on the cup. This, in turn, forces the straw to deflect inwardly but, at the same time, remain in abutting contact with the cup wall. The straw, and most particularly he dual concentric region thereof, when deformed, acts as a biasing force to maintain the bottom end of the straw against the cup wall where, by slightly tilting the cup, substantially all of the beverage may be consumed.

In a similar manner the straw/cup combination of the present invention provides for tight nesting and packaging of cups. Specifically, a straw of preferably flat or oblong cross-section is integrally formed along the inside wall of the cup. A corresponding recess may be formed in the outside wall of the cup to enhance cup nesting.

DESCRIPTION OF THE PREFERRED EMBODIMENT

Figure 1:
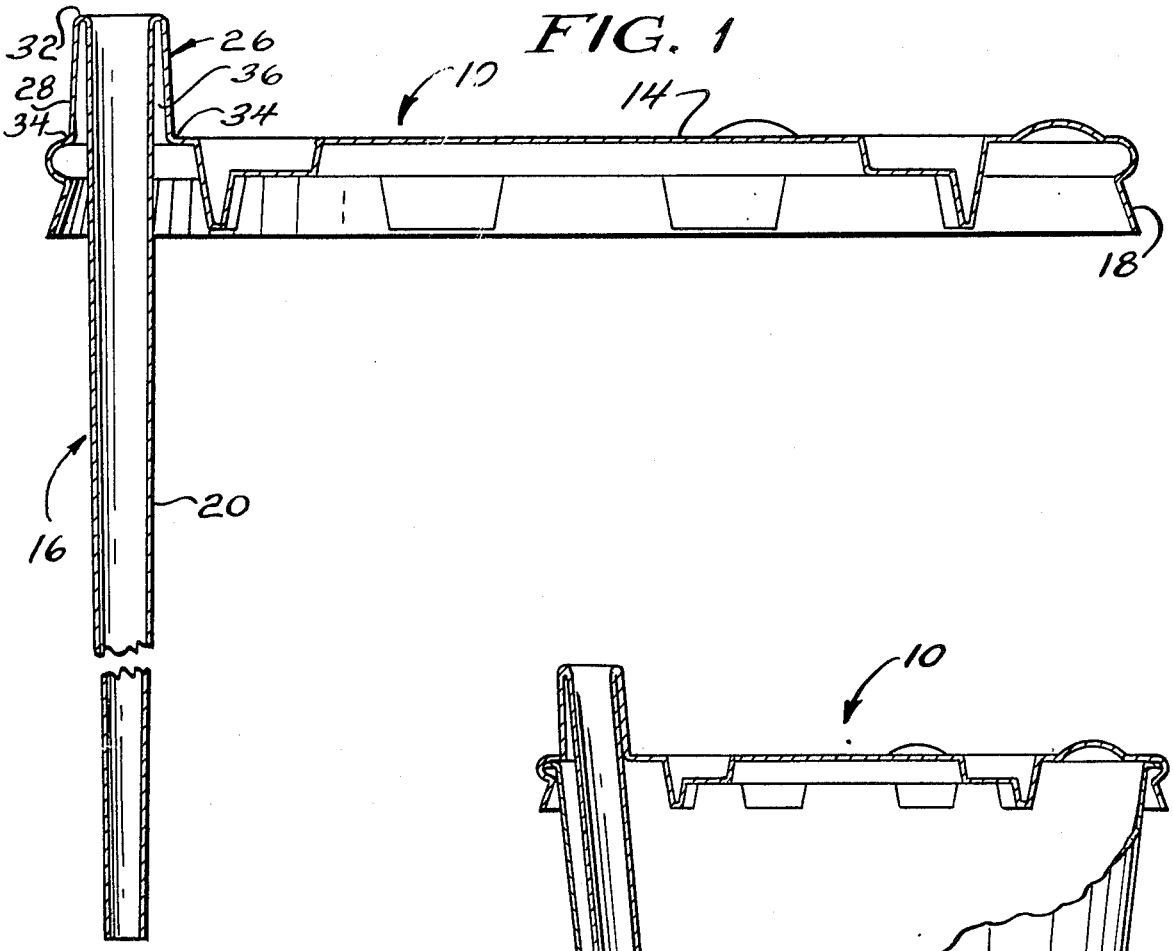
FIG. 1 is an elevation view of the straw/lid of the present invention shown in cross-section.
Figure 2:
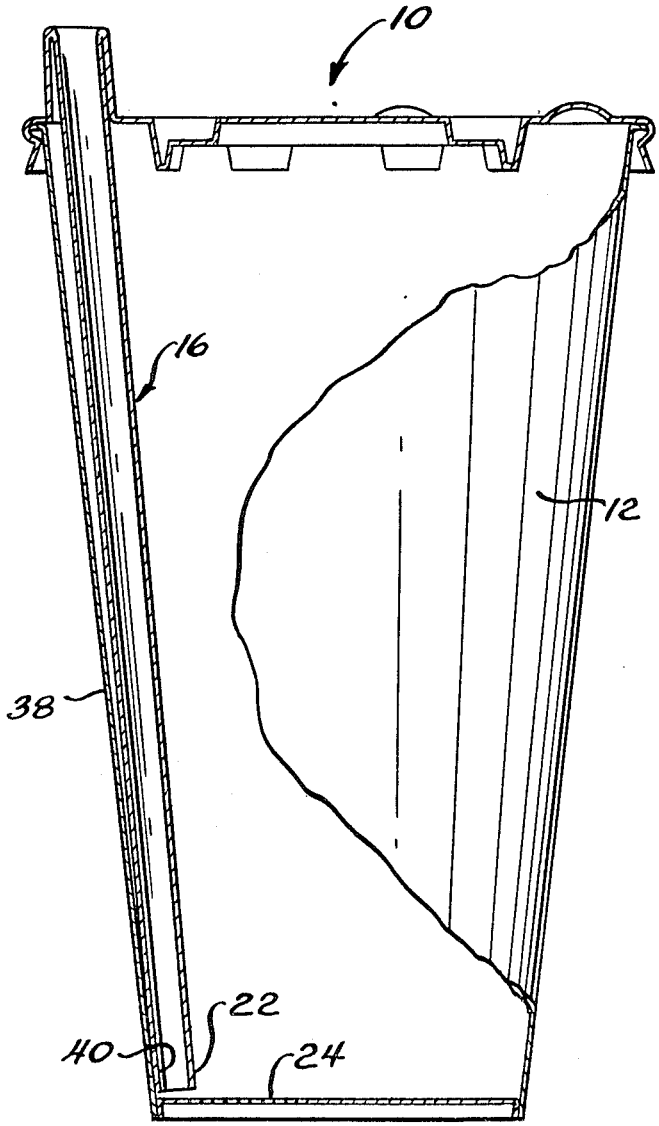
FIG. 2 is an elevation view of the straw/lid of the present invention shown positioned on a cup, portions of the cup are shown broken away and the straw/lid is shown in cross-section for clarity.

FIG. 1 depicts the integral straw/lid 10 of the present invention as it appears just prior to use. FIG. 2 illustrates the same straw/lid as it appears when positioned for use on a tapered beverage container or cup 12.

Referring again to FIG. 1, straw/lid 10 comprises a beverage container lid 14 and a beverage drinking straw 16 of unitary molded plastic construction. It will be appreciated that the present invention serves as a unitary replacement for the conventional cup lid and straw.

Figure 3:
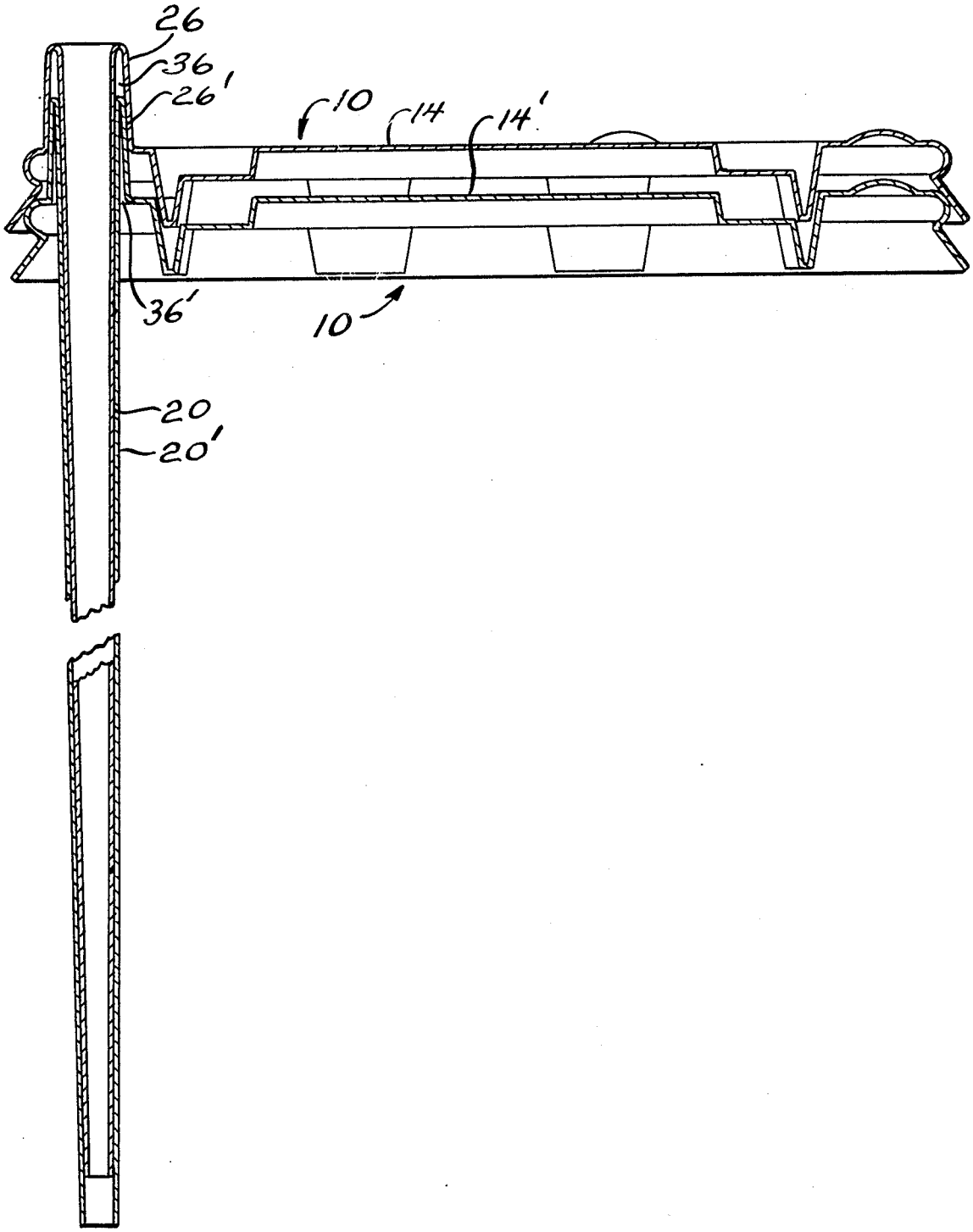
FIG. 3 is an elevation view of two straw/lids of the present invention, shown in cross-section, depicting the nesting therebetween.

As described in more detail hereinafter, the present straw/lid 10 provides the several advanges associated with a reduction in product complexity (e.g. ordering, inventorying, assembling, and dispensing) while simultaneously not sacrificing the ability to densely or bulk package the product for marketing to high-volume fast food and similar establishments. In this connection, FIG. 3 illustrates the nesting of the present straw/lid as required for high-density packaging.

Lid 14 may be of any conventional design, however, it is preferably formed with a lip 18 to engage the underlying cup thereby sealing the combination of cup and straw/lid against spillage. As outlined in more detail below, the unitary straw/lid of the present invention, unlike its two-piece counterparts, inherently self-seals against the loss of beverage by reason of its integral molded fabrication. Straw 16 forms a liquid-tight seal with lid 14. By contrast, inexpensive disposable lids of conventional design generally provide an irregularly shaped aperture through which a straw may be loosely fitted but through which, also, liquid may escape.

A principal feature of the present invention is the structure and placement of straw 16 whereby near-total beverage access can be obtained and, importantly, whereby the straw/lid may be nested for high-density bulk packaging.

As best shown in FIGS. 1 and 2, straw 16 defines an upwardly extending user access region 24 and a downwardly extending beverage engagement region 20.

The user access region 26 is comprised of dual concentric walls 28, 30 of generally cylindrical form that intersect along their respective top edges at 32. More specifically, the outer concentric wall 28 is integrally molded to, and intersects, the lid at 34. This wall tapers, i.e. narrows in diameter, along its length from the lid to its opposed distal end at 32. The inner concentric wall 30 extends from its point of intersection with the outer wall at 32 downwardly generally through the center of the outer wall.

That portion of the inner wall which extends below the plane of the lid comprises the beverage engagement region 20 of the straw. The downwardly extenging beverage engagement region may be of any length, although it is contemplated that various lengths will be provided corresponding to generally available cup sizes. In the preferred arrangement, as shown in FIG. 2, the end portion 22 of the straw will reach substantially to the bottom 24 of cup 12 thereby assuring access to virtually all beverage contained therein without need to remove the straw/lid 10.

The inner concentric wall 30 of the user access region and the beverage engagement region 20 define a uniformly tapering cylindrical contour, narrowing from its uppermost distal end at 32 to the bottom of the straw at 22. In this manner, and referring to FIG. 3, the beverage engagement region 20 of one straw/lid 10 may be received through the top and into the corresponding region 20' of the next lower straw/lid 10' thereby permitting abutting contact between the respective lids 14 and 14'.

The folded-back arrangement of the present straw (i.e. one in which the straw has the appearance of having been fabricated by folding a portion of its tapered length back and downwardly through its center) further aids in the nested stacking of straw/lids 10 by creating a cylindrical, wedge-shaped recess 36 between concentric walls 28,30 into which the user access region 26 of an adjacent stacked straw/lid may be received. This is best illustrated by reference to FIG. 3 wherein the user access region 26' of the lower straw/lid is nested in recess 36 of the strawlid thereabove.

The folded-back structure of the present straw advantageously functions to provide a resilient or elastic cantilever mounting for the downwardly extending beverage engagement region thereby providing a biasing force urging the lower end 22 of the straw into engagement with the side of a complementary tapered cup. This is shown in FIG. 2.

More specifically, straw 16 is preferably off-set, that is, positioned in relatively close proximity to the perimeter of the lid 14. This permits ease of user access while, importantly, assuring an interference condition between the straw and tapered side 38 of the cup wherein the straw is forced inwardly toward the cup center. This, in turn, elastically deforms the plastic straw material, in particular the upper user access region, thereby generating a force to bias the straw against the cup at 40. In this manner, the user can be assured of access to substantially all beverage within the cup simply by tipping the top of the cup, where the straw exits the cup, toward himself.

Figure 4:
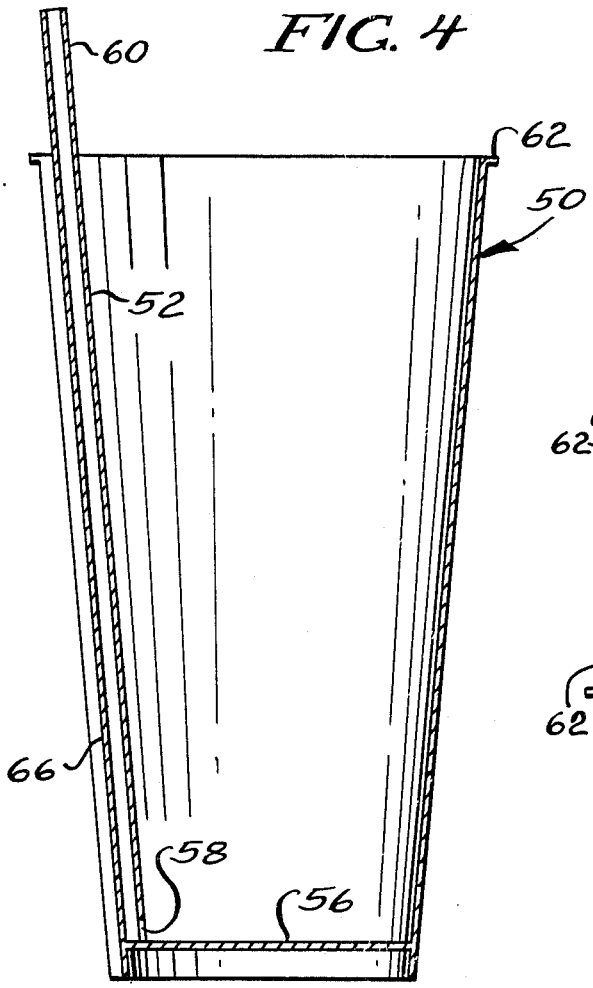
FIG. 4 is an elevation view of the straw/cup of the present invention taken in section along line 4—4 of FIG. 5.
Figure 6:
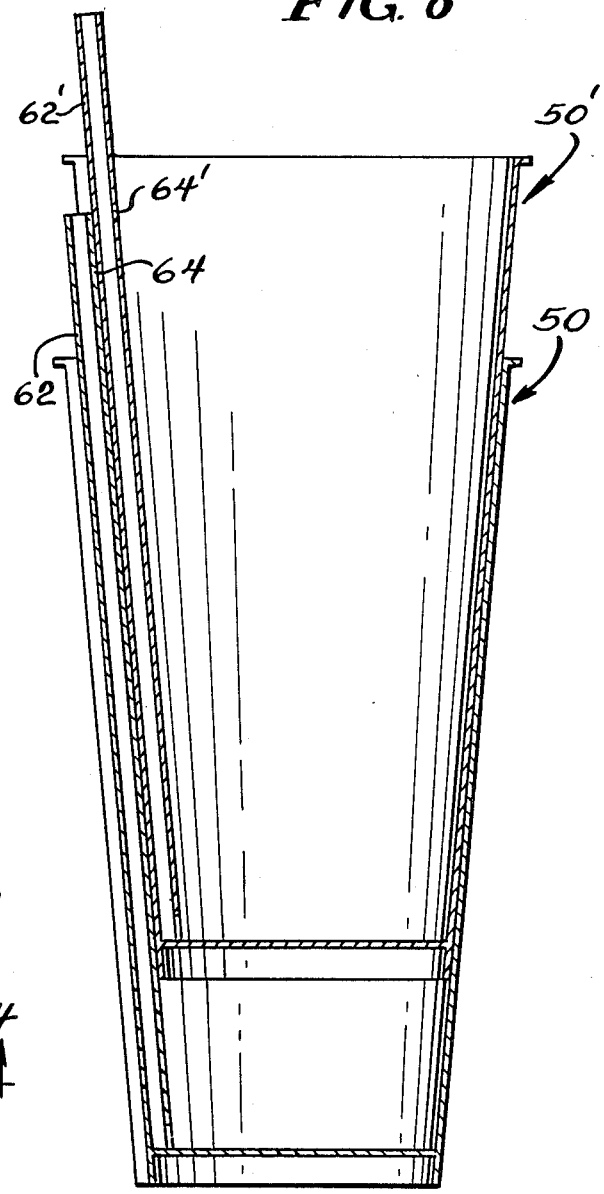
FIG. 6 is a sectional elevantion view illustrating the nested stacking of the straw/cup of FIG. 4.
Figure 5:
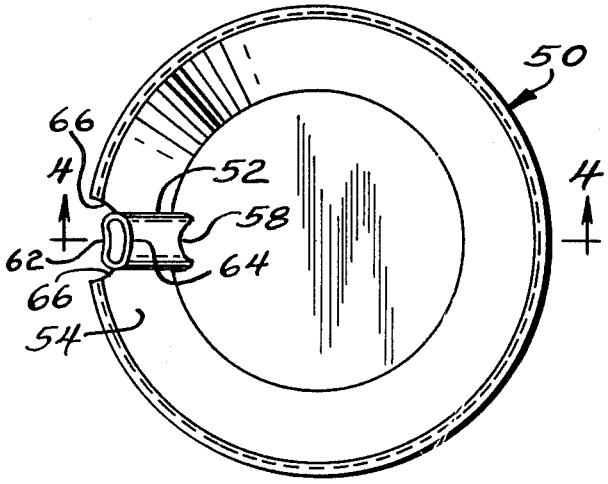
FIG. 5 is a top plan view of the straw/cup of FIG. 4.

FIGS. 4–6 illustrate the straw/cup 50 of the present invention. A straw 52 is integrally molded along, and forms a part of, the sidewall 54 of the cup. The straw extends from the cup bottom 56, at which location an opening 58 is provided in the straw to admit the beverage therein, to an upper point 60 above the cup rim 62 whereby the user may gain access, in the conventional manner, to the contents of the cup.

As best shown in FIG. 5, straw 52 may be formed having a flattened kidney-shaped cross-section to better facilitate the nested stacking of the cups. More specifically, straw 52 defines a pair of arcuate opposed surfaces 62 and 64. Referring to FIG. 6, a pair of nested cups 50, 50' are shown wherein the outer straw surface 62' of the upper cup 50' engages the inner straw surface 64 of the next lower cup 50.

The cup sidewall 54 may be indented, in the region of straw attachment 66, inwardly from the normal frustoconical surface otherwise defining the cup sidewall.

It will be appreciated that the above described straw/lid/cup combinations define an inexpensive molded plastic replacement for conventional multiple-piece disposable drinking receptacles which heretofore have required the separate inventorying and dispensing of straws. Importantly, the present receptacles and receptacle lids achieve the desired single-piece structure and function without sacrificing the nesting and high-density bulk packaging capability necessary for fast food, high volume users.

What is claimed:

1. An integral lid and straw for a disposable drinking cup, the lid having means for attachment of the lid to a cup; the straw having a beverage engaging region extending below the lid and a user access region extending above the lid; means for nestably receiving the beverage engaging straw region of an adjacent integral lid and straw; means for nestably receiving the user access straw region of an adjacent integral lid and straw whereby a plurality of integral lids and straws may be nested in close relative proximity for high density packaging.

2. A lid for a disposable drinking cup including means for attachment of the lid to the top of a drinking cup, a straw integrally formed on the lid, the straw including a first portion extending below the lid for engaging the contents of the cup and a second portion extending above the lid permitting user accesss to the contents of the cup; means for nestably receiving the first and second straw portions of adjacent straws whereby a plurality of integral lids and straws may be nested in close relative proximity for high density packaging.

3. The integral lid and straw of claim 1 wherein the user access region includes concentric tapered inner and outer walls, the outer wall being integrally attached to the lid and extending upwardly therefrom and narrowing in diameter from its point of attachment to its maximum distal extension, the inner wall being integrally attached to the outer wall at said maximum distal extension of the outer wall, the inner wall extending downwardly, and narrowing in diameter, from said point of attachment to a point below the lid, the portion of the inner wall extending below the lid defining the beverage engaging region of the straw; the means for nestably receiving the user access region of an adjacent straw includes the interior volume space defined between the inner and outer concentric walls whereby the user access region of a lower adjacent straw may b received upwardly into said interior volume between the concentric walls; the means for nestably receiving the beverage engaging region of an adjacent straw includes the interior tapered volume space defined within the inner concentric wall whereby the beverage engaging region of an upper adjacent straw may be received downwardly into said interior volume of the inner wall.

4. The integral lid and straw of claim 3 including means for urging the lower distal end of the beverage engaging region of the straw into engagement with the sidewall of a cup placed therebelow, said means includes placement of the straw in off-set orientation on the lid in close proximity to the perimeter edge of the lid whereby the lower distal end of the beverage engagement region of the straw will be forced inwardly by the cup sidewall upon placement of a cup therebelow, said means further including the inner and outer walls of the straw which serve to generate an outward force biasing the straw against the cup upon said inward straw deflection.

* * * * *